United States Patent [19]

Wilde

[11] Patent Number: 4,875,327

[45] Date of Patent: Oct. 24, 1989

[54] CONTAINER FILLING APPARATUS AND METHOD

[75] Inventor: Daniel R. Wilde, Sparta, Mich.

[73] Assignee: Applied Material Handling, Inc., Bailey, Mich.

[21] Appl. No.: 277,642

[22] Filed: Nov. 29, 1988

[51] Int. Cl.[4] ..... B65B 5/10; B65B 39/14; B65B 57/12; B65B 43/42

[52] U.S. Cl. ..... 53/475; 53/74; 53/245; 53/250; 53/259; 53/535; 141/153; 141/270

[58] Field of Search ..... 53/244, 245, 248, 249, 53/250, 255, 259, 473, 475, 535, 74; 141/128, 153, 270, 271

[56] References Cited

U.S. PATENT DOCUMENTS

| | | | |
|---|---|---|---|
| 351,770 | 11/1886 | Hersey et al. | 53/249 |
| 1,308,266 | 7/1919 | Spreckels et al. | 53/249 |
| 1,886,295 | 11/1932 | Morris | 414/295 |
| 2,647,767 | 8/1953 | Cox | 53/248 |
| 2,658,630 | 11/1953 | Melin | 414/791.6 |
| 2,827,082 | 3/1958 | Baum | 53/245 X |
| 2,896,384 | 7/1959 | Carlsen et al. | 53/245 |
| 3,097,460 | 7/1963 | O'Brien | 53/244 X |
| 3,147,846 | 9/1964 | Huntoon | 53/248 |
| 3,229,444 | 1/1966 | Rouse | 53/249 |
| 3,254,755 | 6/1966 | O'Brien | 414/295 |
| 3,269,083 | 8/1966 | Marano | 53/249 |
| 3,283,472 | 11/1966 | Hostetler | 53/244 |
| 3,420,038 | 1/1969 | Crabb | 53/248 |
| 3,492,779 | 2/1970 | Russell | 53/248 |
| 3,521,710 | 7/1970 | Tillotson | 171/61 |
| 3,585,782 | 6/1971 | Staley | 53/244 |
| 3,881,611 | 5/1975 | Milbourn | 414/295 |
| 4,062,168 | 12/1977 | Watts et al. | 53/245 X |
| 4,067,432 | 1/1978 | Powell | 414/295 |
| 4,194,343 | 3/1980 | Myers et al. | 53/493 |
| 4,301,641 | 11/1981 | McElwain et al. | 53/493 |
| 4,428,175 | 1/1984 | Haab | 53/247 |
| 4,600,065 | 7/1986 | Morris | 141/128 X |

FOREIGN PATENT DOCUMENTS

| | | | |
|---|---|---|---|
| 7900877 | 8/1980 | Fed. Rep. of Germany | 53/248 |

OTHER PUBLICATIONS

Wilde Mfg., Inc. Automatic Container Filler.

*Primary Examiner*—Robert L. Spruill
*Assistant Examiner*—Beth Bianca
*Attorney, Agent, or Firm*—Price, Heneveld, Cooper, DeWitt & Litton

[57] ABSTRACT

A container filling apparatus and method that includes a container support movable on a frame so as to raise and lower a container mounted thereon. A conveyor discharge section is also movably mounted on the frame so as to raise and lower the conveyor discharge end. The container support is coupled to the conveyor discharge section by a linkage that provides the container filling apparatus with the ability to initially lower the container support through an initial filling phase while maintaining the conveyor discharge section in a lowered condition, and thereafter simultaneously lower the container support while raising the conveyor discharge section. The linkage preferably includes a slotted bracket pivotally couple to the container support, a joining bracket pivotally mounted on the frame and having a follower mating with the slotted bracket, and a conveyor bracket pivotally mounted to the joining bracket and to the conveyor. Preferably a photoelectric sensor on the conveyor discharge section determines the accumulation of backed up parts to lowering the container support, and alternatively the apparatus includes a pair of side by side container supports for alternatingly filling two containers.

30 Claims, 4 Drawing Sheets

CONTAINER FILLING APPARATUS AND METHOD

BACKGROUND OF THE INVENTION

The present invention relates to container filling apparatus and method, and in particular to container filling apparatus for bulk packing of parts.

Traditional conveyor techniques have been used in the past in the bulk loading of parts into containers. Conventionally a conveyor system is used to transport parts from a part supply to a fill station, at which station the parts are discharged and dropped into the container. Once the container is filled, the conveyor unit is shut off and the filled container replaced. The operator may visually determine that the container is filled, or the filled container can be detected by automated means such as a container weight sensor, a lever operated switch located on the conveyor or the like. Although such a conveyor, filling apparatus is adequate in some applications, this type of system does have the problem of part damage resulting from the dropping of parts from the conveyor to the container. Even relatively sturdy parts, such as machined parts and the like, can be damaged by the drop into the container. Although the height of the drop is reduced as parts accumulate within the container, the drop can be substantial.

In an effort to reduce the damage that results from such an automated filling mechanism, some filling apparatus pivot both the conveyor discharge and container to reduce the drop from the conveyor. Initially the container is pivoted into a raised position and the conveyor discharge end is pivoted downwardly. The container is subsequently lowered through the filling cycle while the conveyor discharge end is simultaneously raised. Although this simultaneous pivoting of the container and the conveyor discharge reduces damage to the parts being packed, damage to the parts still occurs since the simultaneous pivoting still results in a substantial drop from the discharge at various points in the filling cycle.

SUMMARY OF THE INVENTION

The present invention is embodied in a container filling apparatus and method that lowers the container and raises the conveyor discharge in a controlled manner through the filling cycle. Initially the container is raised, and most preferably is pivoted upwardly into an angled position, and the discharge end of the conveyor is dropped. This results in a preselected spacing between the conveyor discharge and the point of contact or contact surface within the container. As parts are deposited into the container the container is first lowered while the height of the conveyor discharge is maintained. At a preselected point in the fill cycle the container is continued to be lowered while the discharge end of the conveyor is simultaneously raised. This results in a complete filling of the container while maintaining the conveyor discharge within a preselected spacing range from the point of contact within the container, thus reducing or minimizing damage to the accumulated parts.

Most preferably, the container filling apparatus includes a container support that is coupled to a movable discharge section of the conveyor. The coupling most preferably includes a three bracket linkage, with one bracket pivotally coupled to the container support, one bracket pivotally coupled to the conveyor discharge section and the other bracket pivotally coupled to a support frame. One of the container support bracket and the frame bracket includes a track while the other bracket includes a mating follower. This linkage permits the container support to lower with the follower moving along the track, until the follower reaches the end of the track and thereafter the conveyor discharge section is raised. Preferably a sensor, and most preferably a photoelectric sensor, determines the back-up of parts at the discharge end of the conveyor and in response lowers the container support until the conveyor discharge end is cleared.

With the disclosed invention, containers are completely filled while damage to packed parts is reduced or minimized, and the apparatus requires minimal overseeing by the operator during use. These and other beneficial results, features and objects of the invention will be understood by one skilled in the art from the specification and claims which follow and drawings appended hereto.

DETAILED DESCRIPTION OF THE PREFERRED EMBODIMENT

Figure 1:
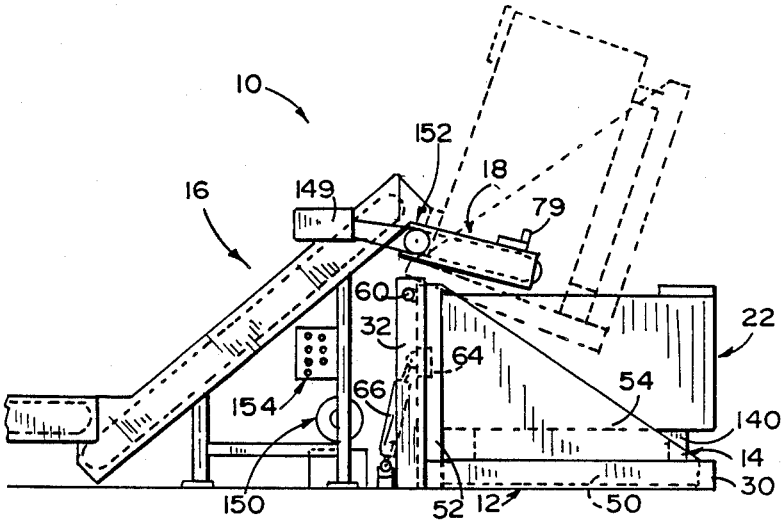
FIG. 1 is an elevational view of a container filling apparatus embodying the invention, showing a container in a lowered, filled condition and showing in phantom a container, in the raised, empty condition.

The present invention is embodied in a container filling apparatus, a preferred form of which is shown in FIG. 1 and referenced by numeral 10. In preferred form container filling apparatus includes a frame 12 on which a container support 14 is mounted. Frame 12 also mounts a conveyor 16 having a discharge section 18 located above container support 14. Container support 14 and discharge section 18 are coupled by a pair of linkages 20 (FIG. 4), one for each side of conveyor discharged section 30. Linkages 20 form couplings that provide for the preselected movement of container support 14 and discharge section 18 through the container filling cycle. Container support 14 (FIG. 1) is configured and adapted to support a container 22. At the start of the filling cycle container filling apparatus 10 raises container 22 and lowers conveyor discharge section 18 to reduce the drop from discharge section 18 into container 22. During the filling cycle, as parts are deposited into container 22, container support 14 initially lowers container 22 through an initial filling phase. During this initial filling phase conveyor discharge section 18 is maintained in a lowered position. After the initial filling phase, container support 14 continues to lower container 22 in response to the accumulation of parts in container 22, while conveyor discharge section 18 is simultaneously raised. Container filling apparatus 10 therefore completely fills container 22 while throughout the fill cycle apparatus 10 maintains a preselected range of spacing between discharge section 18 and the pile of accumulated parts within container 22. This reduces or minimizes the drop from discharge section 18 to the surface first struck by the dropped part, whether that surface is the inside of container 22 or the top of the pile of accumulated parts.

Figure 2:
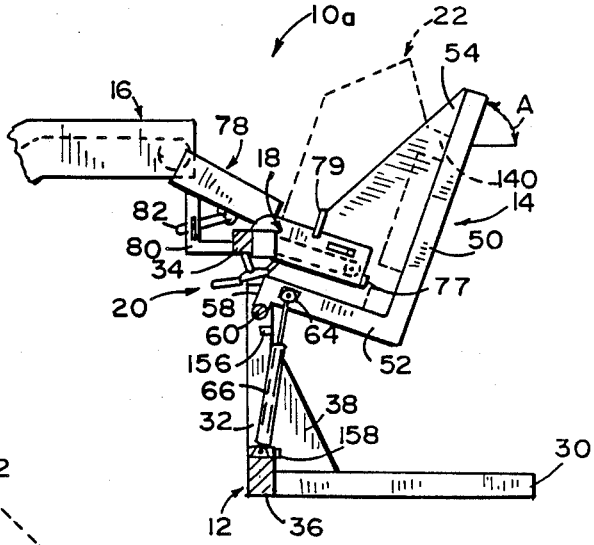
FIG. 2 is a fragmentary, side sectional view of a container filling apparatus forming another embodiment of the invention, shown in a raised, empty container condition.
Figure 3:
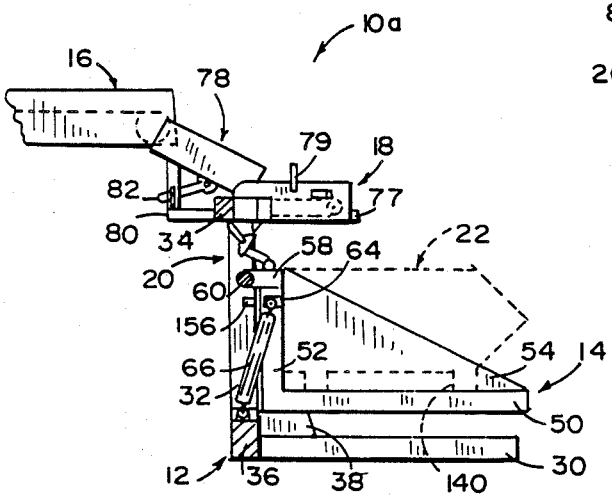
FIG. 3 is a fragmentary, side sectional view of a container filling apparatus of FIG. 2, shown in a lowered, filled container condition.

Another preferred embodiment is shown in FIGS. 2 and 3 and referenced by numeral 10*a*. Container filling apparatus 10*a* is similar to container filling apparatus 10, with the exception of the distinctions identified herein. Frame 12 includes a pair of generally parallel floor runners 30. A vertical leg 32 extends upright from each floor runner Legs 32 are joined at their upper ends by a horizontal upper crossbar 34, and at their base by a horizontal floor crossbar 36. Floor runners 30 and floor crossbar 36 define a loading zone in which container 22 is supported. Triangular side gussets 38 extend between floor runners 30 and vertical legs 32 in order to reinforce frame 12.

Figure 4A:
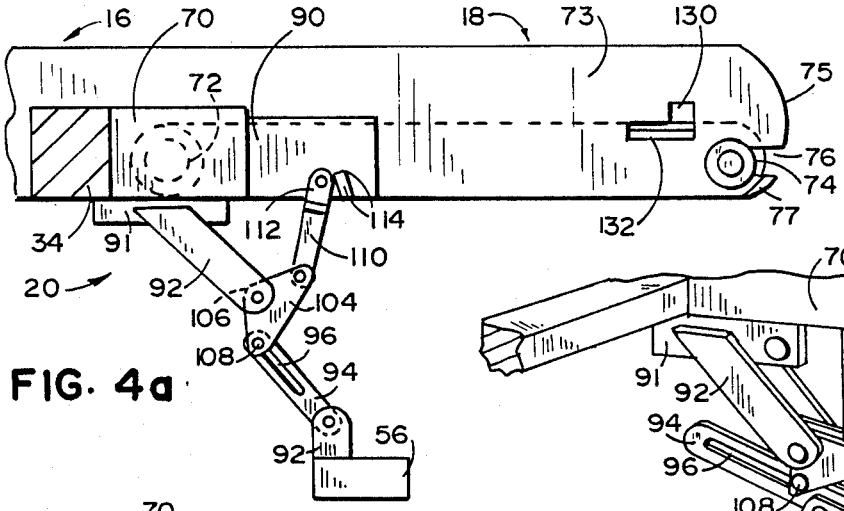
FIGS. 4*a*, 4*b* and 4*c* are fragmentary side view of the coupling linkage between the container support and conveyor discharge section of FIG. 3, shown in a lowered, filled container condition, a raised, empty container condition and a partially filled container condition, respectively.
Figure 4B:
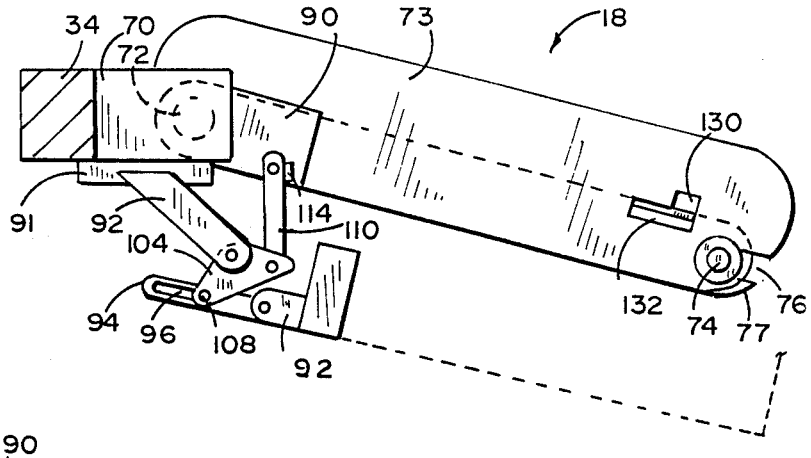
Figure 4C:
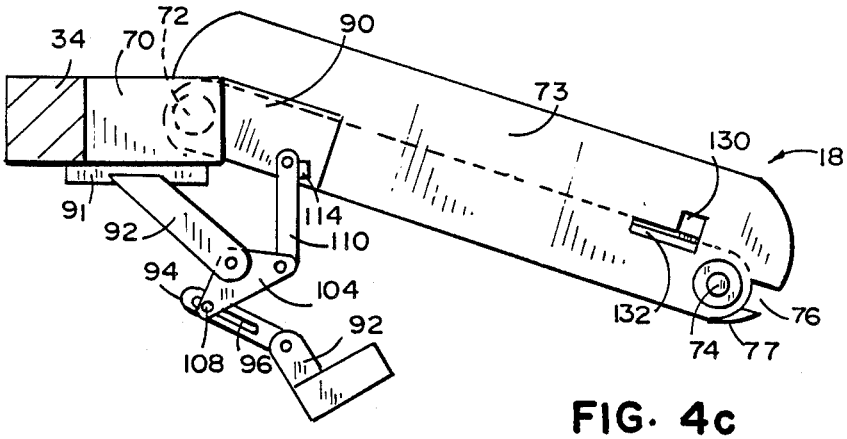

Container support 14 includes a floor 50 that cantilevers forward from a back wall 52. Angled sidewalls 54 slope downwardly toward the front of container support 14. The upper edge of back wall 52 forms a short top wall 56 (FIG. 4). A pair of pivot bracket 58 projects rearwardly from the upper edge of back wall 52 (FIGS. 2–3). Pivot brackets 58 are used to pivotally mount container support 14 on frame 12. An axle 60 extends through pivot brackets 58 and is received in vertical legs 32. Appropriate bushings or bearings in vertical legs 32 mount axle 60 so as to freely rotate. When in an at rest position, container support 14 depends from axle 60. As shown in FIG. 1, in container filling apparatus 10 when in a lowered position back wall 52 is sufficiently long that container support floor 50 is positioned substantially at ground level between floor runners 30. In container filling apparatus 10*a* when in a lowered position back wall 52 is somewhat shorter so that container support floor 50 is spaced above floor runners 30.

A pair of cylinder mounting pads 64 are located on back wall 52 toward the sides of each container support 14 and below pivot bracket 58 (FIGS. 1–3). A pair of hydraulic cylinders 66 are mounted between floor crossbar 36 and cylinder mounting pads 64. Alternatively, pneumatic cylinders, mechanical screw jacks or the like may be used in place of hydraulic cylinder 66. Cylinder 66 is used to pivot container support 14 into a raised position shown in FIG. 2 and then lower container support 14 back down to the lowered position shown in FIG. 3. Cylinder 66 is conventionally coupled to a hydraulic pump and valves (not shown).

Figure 8:
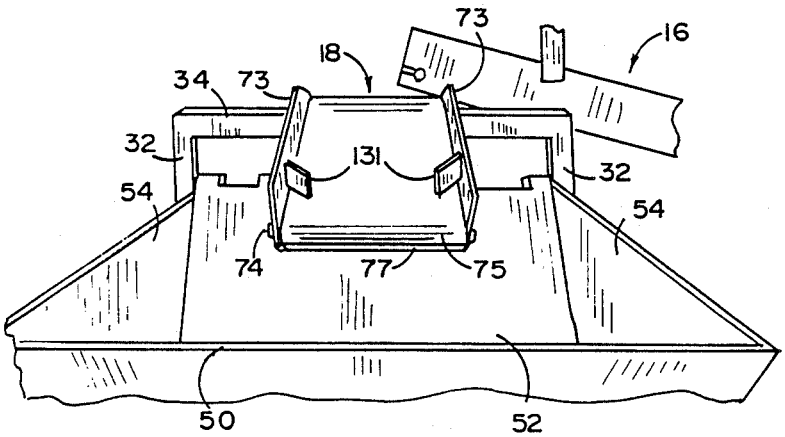
FIG. 8 is a front elevational view of the container filling apparatus of FIG. 1.

Conveyor discharge section 18 is pivotally mounted so as to cantilever forward of upper crossbar 34 (FIGS. 2–4). A pair of conveyor mount brackets 70 project forwardly from upper crossbar 34 (FIG. 4). Conveyor discharge section 18 is mounted on a pivot axle 72 extending between conveyor mount brackets 70. Axle 72 has appropriate bearings fastened to the inner surfaces of conveyor mount brackets 70 so as to permit discharge section 18 to freely pivot. Conveyor discharge section has sidewalls 73 that project above the conveyor belt (not shown) to maintain parts on conveyor 16. A forward conveyor belt axle 74 is adjustably mounted in a slot 76 at a forward discharge end 75 of discharge section 18. Axle 74 is adjustably mounted so as to provide a take-up adjustment for the conveyor belt of conveyor 16. The conveyor belt may extend back from conveyor belt axle 74 as a single element back into the remainder of conveyor 16. In this embodiment, the flexible conveyor belt permits discharge section 18 to pivot downwardly and upwardly with the belt running back through the remainder of conveyor 16. Alternatively, as shown in FIGS. 2 and 3, an adjustable chute section 78 discharges onto conveyor discharge section 18. Adjustable chute section 78 provides a chute that parts slide along after dropping off of the remainder of conveyor 16. Adjustable chute section 78 is mounted on a support frame 80, and a locking adjustment bracket 82 locks the height adjustment of adjustable conveyor section 78. In this embodiment, conveyor discharge section 18 includes its own short conveyor belt. A flexible flapper panel 79 is mounted from a bracket on discharge section 18 so as to hang down to the conveyor surface. Flapper panel 79 slows the roll of round parts along discharge section 18. This reduces damage to parts that would otherwise roll too quickly down conveyor 16. A flat panel 77 (FIG. 8) extends across discharge end 75 at the lower region of the conveyor. This prevents parts that have accumulated in container 22 from being drawn back up under discharge section 18.

Each linkage 20 (FIGS. 4–7) is coupled between container support top wall 56, one conveyor discharge section sidewall 73 and frame 12. Linkages 20 are mirror images of each other, and so only one linkage 20 is described. Secured to each conveyor sidewall 73 is a reinforcing plate 90 that forms a mounting region for linkage 20, while a linkage fixed mounting plate 91 depends from upper crossbar 34. A pair of spaced mounting tabs 92 project up from container support upper wall 56 (FIG. 4). A slotted bracket 94 is pinned at one end between mounting tabs 92 in order to provide a pivot point for slotted bracket 94. Slotted bracket 94 has a slot 96 that extends along its end opposite tabs 92. A pair of spaced mounting brackets 102 angle downwardly and forwardly of fixed mounting plate 91. A pair of spaced triangular-shaped plates form a joining bracket 104. The spacing of the plates forming joining bracket 104 is maintained by a cylindrical tube located at the apex 106 of the triangular-shaped bracket, which also holds the plates together. A pin received between mounting brackets 102 and the apex of joining bracket 104 forms a pivot for joining bracket 104, with the cylindrical tube acting as a bushing. A pin 108 at a lower corner of triangular joining bracket 104 is received through slot 96 on slotted bracket 94. Pin 108 therefore forms a follower that slides along slot 96. Alternatively, joining bracket 104 defines slot 96 while slotted bracket 94 includes follower pin 108.

Figure 5:
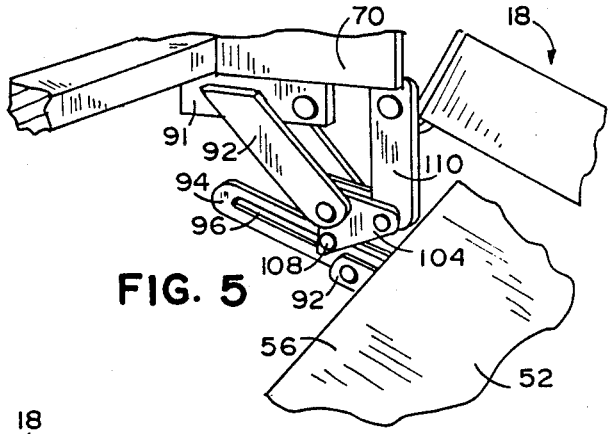
FIG. 5 is a fragmentary, perspective view of the coupling linkage of FIG. 4, shown in a raised, empty container condition.
Figure 7:
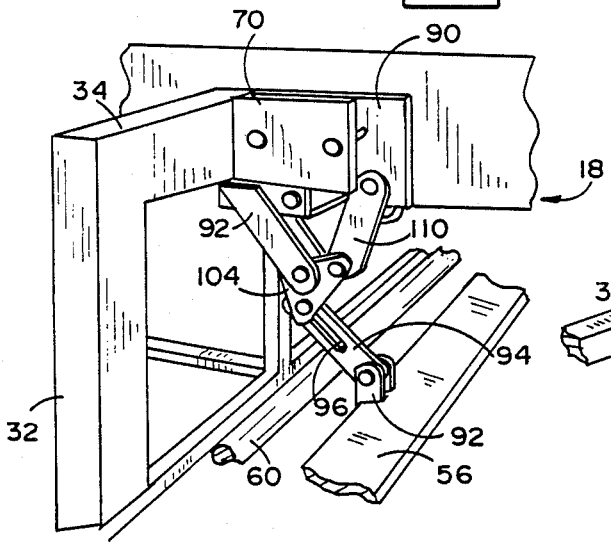
FIG. 7 is a fragmentary, perspective view of the coupling linkage of FIG. 5, shown in a lowered, filled container condition.

A conveyor bracket 110 is pinned between the triangular plates of joining bracket 104 at the remaining corner of joining bracket 104. Conveyor bracket 110 therefore pivots in relation to joining bracket 104. Conveyor bracket 110 has a forked upper end 112. Forked upper end 112 forms a slot that is received on either side of reinforcing plate 90 and is pinned to provide a pivot. A stop tab 114 projects outwardly from the side of reinforcing plate 90 just forward of conveyor bracket 110. Stop tab 114 slopes forwardly and downwardly so as to be brought into abutment with forked upper end 112 when conveyor discharge section 18 is dropped to its lowermost position (FIG. 5).

Frame 12, container support 14 and conveyor discharge section 18 are thus coupled by three bracket linkages 20. As shown in FIG. 5, when container support 14 is pivoted upwardly slotted bracket 94 is raised, which in turn permits joining bracket 104 to pivot with pin 108 sliding along slot 96. The weight of conveyor discharge section 18 causes conveyor bracket 110 to drop, thus pivoting joining bracket 104 in a clockwise direction as shown in FIGS. 4–7. As container support 14 is pivoted downwardly, slotted bracket 94 is lowered. Slot 96 is slid along pin 108, while gravity holds conveyor discharge section 18 in a downwardly pivoted orientation. At the point when pin 108 reaches the end of slot 96 (FIG. 6), the continued downward pivoting of container support 14 draws slide bracket 94 downwardly. Slotted bracket 94 thus pulls 108 downwardly and forwardly on pin 108 as joining bracket 104 pivots on mounting brackets 102. Mounting brackets 102 provide a fulcrum on joining bracket 104 between slotted bracket 94 and conveyor bracket 110. Joining bracket 104 therefore forces conveyor bracket 110 upwardly, thus pivoting discharge end 75 upwardly.

Container 22 (FIGS. 1–3) may preferably have a variety of overall configurations with an open loading top. Container 22 preferably has a set of short legs 140 that raise the undersurface of container 22 up off of container support floor 50. This raising of container 22 permits a front end loader or other loading equipment to slide a fork underneath container 22 for handling.

A parts back-up sensor 130 (FIG. 4) is located on discharge section 18 adjacent discharge end 75. Sensor 130 is mounted on a sensor bracket 132 projecting from conveyor sidewall 73. Sensor 130 most preferably is a photoelectric sensor positioned to detect the back-up of parts at discharge end 75. A deflector bracket 131 projects from each sidewall 73 upstream of sensor 130, which prevent parts from jamming sensor 130. Alternatively, sensor 130 may preferably be a mechanical switch that is thrown by the back-up of parts at discharge end 75, or other alternative sensors. Sensor 130 is connected to a conventional adjustable timer circuit that prevents sensor 130 from generating a signal until sensor 130 detects a parts back-up for a preselected time interval. Although this time interval is adjustable, the preferred time interval is five seconds.

As shown in FIG. 1, conveyor 16 is powered by a conveyor motor 149 through an adjustable gear drive 152. Adjustable gear drive 152 provides container filling apparatus 10 with the ability to vary the speed of conveyor 16. A hydraulic motor 150 powers cylinder 66. Controls 154 control the start up and shut off of conveyor 16. Sensor 130 is also operably connected through a conventional circuit with the hydraulic circuit of cylinder 66, so that when sensor 130 detects a back-up of parts that lasts for the preselected time interval cylinder 66 lowers container support 14 until sensor 130 no longer detects a parts back-up. Container support 14 is therefor lowered just until the parts back-up is cleared, resulting in little or no drop from discharge end 75 to the accumulated parts.

An adjustable limit switch 156 (FIG. 2) is mounted on one vertical leg 32. Adjustable limit switch 156 is mounted so as to be movable out into the path of container support 14 and contact one sidewall 54. Adjustable limit switch 156 is also adjustable forward and backward so as to selectably contact sidewall 54 at a range of locations through the lowering cycle of container support 14. Adjustable limit switch 156 is connected in the circuit with controls 154, so that when adjustable limit switch 156 is contacted conveyor 16 is shut down and container support 14 is lowered to the fully lowered position (FIG. 3). The location of adjustable limit switch 156 may therefor be adjusted to be contacted and provide for the preselected partial filling of container 22. A fixed limit switch 158 is fixedly mounted on one vertical leg 32 beneath adjustable limit switch 156. Fixed limit switch 158 is positioned to be contacted by container support 14 when container support is lowered to a fully lowered position (FIG. 2). Fixed limit switch is connected in a circuit with controls 154, so that when fixed limit switch 158 is contacted cylinder 66 is shut off and the lowering of container support 14 stops. Alternatively fixed limit switch 158 may additionally light a signal light or sound an operator alarm.

In operation, container support 14 is in a lowered condition (FIG. 3) without a container 22 loaded onto container support floor 50. An empty container 22 is loaded onto container support 14 by a fork lift truck or other container handling equipment. The operator raises container support 14 through cylinder 66 until container support 14 is in the fully raised condition shown in FIG. 2. In this fully raised condition, container support floor 50 forms an angle "A" (FIG. 2) with the horizontal. Most preferably angle "A" is approximately seventy degrees, so that back wall 52 forms a twenty degree angle with a horizontal line. The raising of conveyor support 14 releases discharge section 18 to pivot downwardly due to gravitational forces. Discharge end 75 is most preferably spaced at most approximately six inches above the back wall of container 22 located below discharge end 75.

Conveyor 16 is activated, causing parts to be conveyed onto discharge section 18 and then discharged into container 22. Preferably, the greatest drop from discharge end 75 is that which occurs at the start of the fill cycle, which is at most about six inches down to the contact surface of the container. The parts drop into container 22 and commence piling up until sensor 130 determines a parts back-up at discharge end 75 that is sustained for the preselected time interval. In response to sensor 130, cylinder 66 pivots container support 14 downwardly until sensor 130 is cleared. Parts continue to be conveyed to container 22, with the result that through the majority of the fill cycle parts are pushed off of discharge end 75 onto the accumulated pile with little or no drop from discharge end 75 onto the contact surface of the pile. Through an initial filling phase of the filling cycle, container support 14 pivots downwardly without change in elevation of conveyor discharge end 75. Parts accumulate within container 22 after little or no fall from discharge end, with the maximum fall preferably being approximately six inches from discharge end 75.

Figure 6:
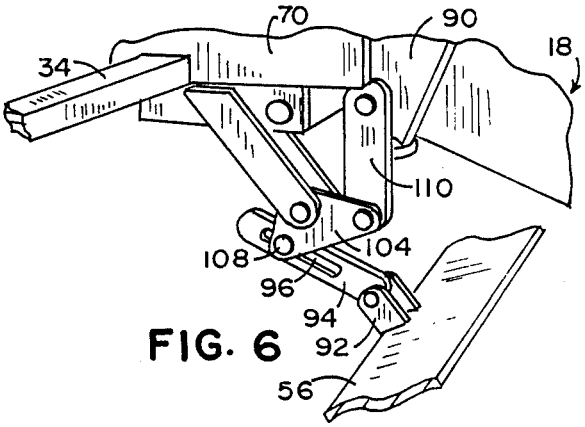
FIG. 6 is a fragmentary, perspective view of the coupling of FIG. 5, shown in a partially lowered, partially filled container condition.

When container support 14 is pivoted downwardly to an angle "A" of approximately ten degrees from the horizontal, which occurs approximately eighty percent through the filling cycle, pin 108 of joining bracket 104 is slid to the end of slotted bracket 94 (FIG. 6). At this point slotted bracket 94 pivotally engages joining bracket 104 so that further lowering of container support 14 pivots joining bracket 104 in a counterclockwise direction as shown in FIGS. 4–7. The continued staged lowering of container support 14 in response to sensor 130 thus raises conveyor bracket 110, causing conveyor discharge section 18 to pivot upwardly simultaneous with the lowering of container support 14. This provides conveyor 16 with the ability to completely fill container 22. Most preferably discharge end 75 is not spaced more than approximately six inches above the top of parts accumulated within container 22 at any stage of the fill cycle, with there being little or no spacing in the later stages of the fill cycle. A fork lift or other material handling equipment is used to pick container 22 off of container support 14 after container 22 has been completely filled any thereafter replaced by an empty container 22.

Most preferably floor runners 30 are about fifty inches long and container support floor 50 is between forty-two and forty-six inches long. Floor 50 is most preferably forty inches wide and spaced between four and thirteen inches above the supporting floor surface height. Most preferably conveyor is one foot wide, with discharge section 18 three feet long and the remainder of conveyor 16 six feet long. Motor 149 is most preferably a 230/460 volt three phase motor. Slotted bracket is most preferably two and one half inches between pivot points. Joining bracket 104 most preferably spaces apex 106 pivot two inches from follower pin 108, and spaces apex 106 pivot one and seven eighths inch from the pivot for conveyor bracket 110. Conveyor bracket 110 most preferably spaces the pivots at its two ends four and three sixteenths inches.

Figure 9:
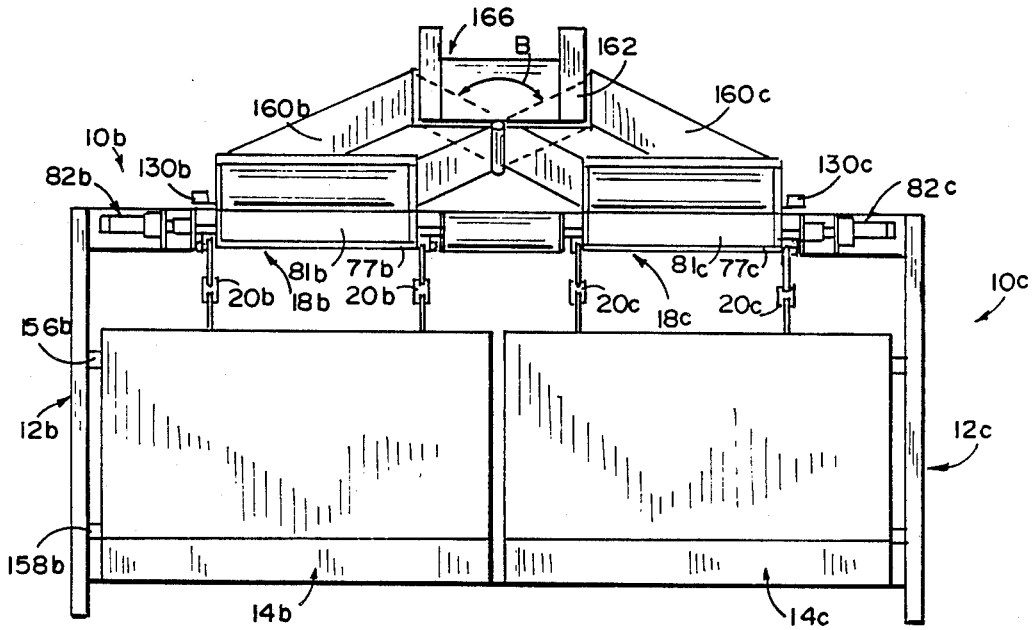
FIG. 9 is a front elevational view of an alternative container filling apparatus used to alternatingly fill two containers, shown in a lowered, filled container condition.

Shown in FIG. 9 is an alternative preferred embodiment, a container filling apparatus **10*b*, in which a pair of container supports 14*b* and 14*c* are positioned in a side by side relationship. Container filling apparatus 10*b* (FIG. 9) is similar to container filling apparatus 10*a*, with the exceptions pointed out below. Container filling apparatus 10*b* therefor includes a frame 12*b* that is supplied parts by a conveyor 16*b*. Each of container supports 14*b* and 14*c* include a corresponding individual discharge section 18*b* and 18*c*. Container supports 14*b* and 14*c* are each coupled to the corresponding discharge section 18*b*, 18*c* by a pair of three bracket linkages 20*b*, 20*c*. Each conveyor discharge section 18*b*, 18*c* includes a conveyor belt 81*b*, 81*c*. Conveyor belts 81*b* and 81*c* are each individually driven by an individual discharge conveyor drive 82*b* and 82*c*. Each container support 14*b*, 14*c* has its own hydraulic cylinder (not shown), and an adjustable limit switch 156*b*, 156*c* and a fixed limit switch 158*b*, 158*c***.

A pair of angled directing chutes **160*b* and 160*c* extend from the remainder of conveyor 16*b* to the corresponding conveyor discharge section 18*b* and 18*c*. Parts therefore slide along chutes 160*b* and 160*c* after dropping off of conveyor 16*b*. A directing panel 162 is pivotally mounted between chutes 160*b* and 160*c*. Directing panel 162 pivots through angle "B" so as to selectively block off one of chutes 160*b* and 160*c* and direct the flow of parts down the other of chutes 160*b* and 160*c*. Alternatively, directing chutes 160*b*, 160*c* and directing panel 162 may be replaced with a short lateral conveyor (not shown) that is reversible. In this embodiment the parts are discharged by the remainder of conveyor 16 onto the lateral conveyor, and the lateral conveyor is run in one direction or the other to discharge onto the selected one of discharge ends 18*b*, 18*c***.

With container filling apparatus **10*b*, an empty container 22 may undergo the filling process while a previously filled container 22 is being removed from an adjacent container support 14*b* or 14*c*. With container filling apparatus 10*b*, continuous parts flow can be maintained even during the exchange of containers 22**.

Alternatively container support **14, 14*a*, 14*b* or 14*c* may be mounted to slide vertically along vertical legs 32, such as along tracks or the like, in order to raise and lower container 22. Conveyor discharge section 18 may also alternatively be mounted to slide vertically along vertical legs 32 to raise and lower discharge end 75**. Alternative conveyor systems may also be used for a parts supply.

Figure 10:
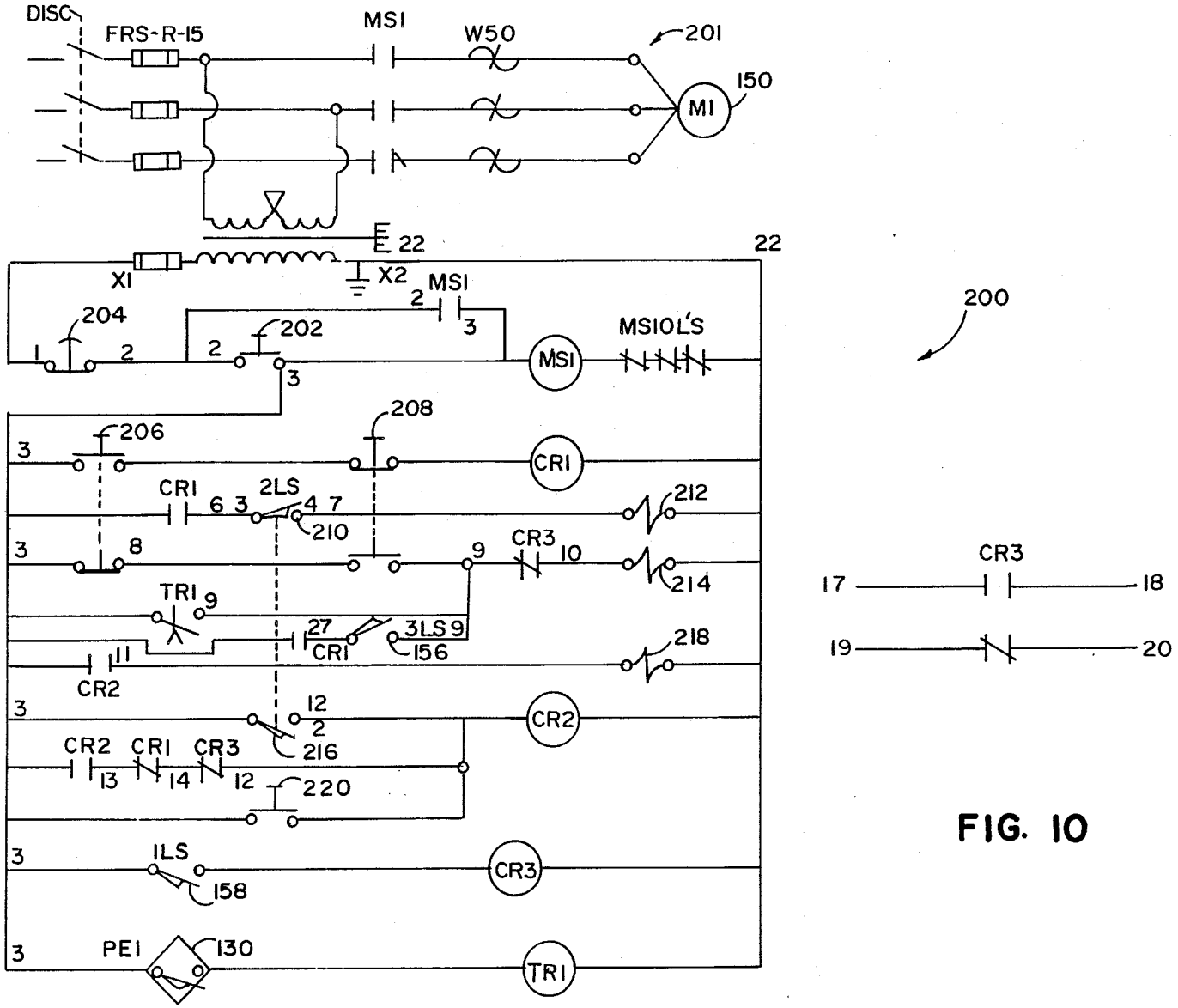
FIG. 10 is a schematic drawing of the preferred control circuit for a container filling apparatus embodying the invention.

Shown in FIG. 10 is a schematic diagram of the preferred control circuit 200 for container filling apparatus 10 and **10*a*. As shown in FIG. 10 a master control and power circuit 201 is used in the start up of motor 149. Master control circuit 201 also includes a power start up switch 202 and a power shut off switch 204. Circuit 200 includes a manual container raising switch 206 to pivot container support 14 upwardly as well as a manual container lowering switch 208 for pivoting container support 14 downwardly. Maximum tilt or raised limit switch 210 is thrown when container support 14 has reached the maximum raised position. Circuit 200 includes a solenoid or a hydraulic valve 212 that is used to raise cylinder 66, while a solenoid or hydraulic valve 214 lowers cylinder 66. Limit switch 210 starts up conveyor 16 when container support 14 reaches the fully raised position. A solenoid or other switch 218 activates conveyor 16. CR3 also may control auxiliary equipment. Circuit 200 also includes a conveyor restart switch 220, along with fixed limit switch 158, adjustable limit switch 156, and photoelectric sensor 130**.

It is to be understood that the above is a description of the preferred embodiments, and one skilled in the art will appreciate that various modifications and improvements may be made without the departing from the spirit of the invention disclosed herein. The scope of protection afforded is to be determined by the claims which follow and the breadth of interpretation that the law allows.

The embodiments of the invention in which an exclusive property or privilege is claimed are as follows:

1. A container filling apparatus for filling containers with product during a filling cycle, comprising:

a frame;

a conveying element having a discharge section with a discharge end, at least said discharge section movably mounted on said frame so as to raise and lower said discharge end between a lowered discharged position and a raised discharged position;

a container support movably mounted on said frame and disposed to position a container beneath said discharge end, said container support movably mounted so as to lower a container supported thereon from a raised container position through an initial filling phase and then through a completion filling phase to a lowered container position, and to raise said container support;

a container support lowering apparatus coupled to said container support and adapted to raise and lower said container support;

means coupling said container support to said conveying element so as to maintain said discharge end in said lowered position as said container support is lowered through said initial filling phase, and simultaneously raising said discharge end as said container support is lowered through said completion filling phase, whereby the distance between said discharge end and said product collected in a container on said container support is reduced through said filling cycle.

2. The apparatus of claim 1, wherein:

said container support is pivotally mounted on said frame so as to pivot between said raised container position and said lowered container position.

3. The apparatus of claim 2, wherein:

said discharge section is pivotally mounted on said frame so as to pivotally raise and lower said discharge end.

4. The apparatus of claim 3, wherein:

said container support is coupled to said discharge section by a coupling comprising a pivotally mounted first bracket with a follower track thereon.

5. The apparatus of claim 4, wherein:

said coupling further comprises a second bracket having a follower mating with said follower track and a third bracket pivotally mounted on one of said first bracket and second bracket.

6. The apparatus of claim 5, wherein:

said first bracket is pivotally mounted on said container support, said second bracket is pivotally mounted on said frame and said third bracket is pivotally mounted on said discharge section.

7. The apparatus of claim 6, wherein:

said second bracket is pivotally mounted to said frame to form a fulcrum disposed between said first bracket and said second bracket.

8. The apparatus of claim 7, further comprising:

a sensor disposed on said discharge section proximate said discharge end and adapted to sense the accumulation of parts at said discharge end, said sensor operatively coupled to said container support lowering apparatus.

9. The apparatus of claim 8, wherein:

said discharge end is maintained through said filling cycle at a maximum height of approximately six inches above a contact surface in a container positioned on said container support.

10. The apparatus of claim 9, further comprising:

a plurality of said container supports and a plurality of said discharge sections coupled to corresponding ones of said container supports;

a part supply mechanism coupled to said discharge sections, said part supply mechanism including means for selectively directing parts to a selected one of said discharge sections.

11. The apparatus of claim 1, wherein:

said discharge section is pivotally mounted on said frame so as to pivotally raise and lower said discharge end.

12. The apparatus of claim 1, wherein:

said container support is coupled to said discharge section by a coupling comprising a pivotally mounted first bracket with a follower track thereon.

13. The apparatus of claim 12, wherein:

said coupling further comprises a second bracket having a follower mating with said follower track and a third bracket pivotally mounted on one of said first bracket and second bracket.

14. The apparatus of claim 1, wherein:

said container support is coupled to said discharge section by a coupling comprising a first bracket pivotally mounted on said container support, a second bracket pivotally mounted on said frame, a third bracket pivotally mounted on said discharge section and pivotally coupled to said second bracket, one of said first bracket and said second bracket having a track and the other of said first bracket and said second bracket having a follower mating with said track.

15. The apparatus of claim 14, wherein:

said second bracket is pivotally mounted to said frame to form a fulcrum between said first bracket and said second bracket.

16. The apparatus of claim 1, further comprising:

a sensor disposed on said discharge section proximate said discharge end and adapted to sense the accumulation of parts at said discharge end, said sensor operatively coupled to said container support lowering apparatus.

17. The apparatus of claim 1, wherein:

said discharge end is maintained through said filling cycle at a maximum height of approximately six inches above a contact surface in a container positioned on said container support.

18. The apparatus of claim 1, further comprising:

a plurality of said container supports and a plurality of said discharge sections coupled to corresponding ones of said container supports;

a part supply mechanism coupled to said discharge sections, said part supply mechanism including means for selectively directing parts to a selected one of said discharge sections.

19. A container filling apparatus for filling containers with product during a filling cycle, comprising:

a frame;

a parts conveyor having at least one discharge section with a discharge end, at least said discharge section movably mounted on said frame to raise and lower said discharge end;

a container positioning element movably mounted on said frame and disposed to position a container beneath said discharge end, said container positioning element movably mounted so as to lower and raise a container positioned thereby;

a coupling comprising a first bracket pivotally mounted on aid container positioning element, a second bracket pivotally mounted on said frame, a third bracket pivotally mounted to said discharge section and pivotally mounted to said second bracket, one of said first bracket . and said second bracket having a track and the other of said first bracket and said second bracket having a follower mating with said track;

a container lowering apparatus coupled to said container positioning element and adapted to raise and lower said container positioning element.

20. The apparatus of claim 19, wherein:

said second bracket is pivotally mounted on said frame to form a fulcrum between said first bracket and said third bracket.

21. The apparatus of claim 20, wherein:

said first bracket includes said track.

22. The apparatus of claim 21, further comprising:

a plurality of said container positioning elements and a plurality of discharge sections coupled to corresponding ones of said container positioning elements.

23. The apparatus of claim 19, further comprising:

a plurality of said couplings.

24. A method of filling a container with product, comprising:

providing a parts container;

providing a parts conveyor with a discharge end;

first raising said parts container and lowering said discharge end;

conveying parts from said parts conveyor to said parts container;

second lowering said parts container while substantially maintaining the height of said discharge end, and continuing conveying parts from said parts conveyor to said parts container;

third lowering said parts container while raising said discharge end, and continuing conveying parts from said parts conveyor to said parts container.

25. The method of claim 24, wherein:

said parts container raising and lowering steps include pivoting said container.

26. The method of claim 24, wherein:

said discharge end raising and lowering steps include pivoting said discharge end.

27. The method of claim 24, wherein:

said raising and lowering steps maintain said discharge end at a maximum spacing range of approximately six inches above a contact surface in said container.

28. The method of claim 27, further comprising:

sensing the accumulation of parts in said container and lowering said container in response to said sensing.

29. The method of claim 24, further comprising:

sensing the accumulation of parts in said container and lowering said container in response to said sensing.

30. The method of claim 24, further comprising:

filling a first one of said containers while simultaneously removing a second, previously filled one of said containers.

* * * * *

UNITED STATES PATENT AND TRADEMARK OFFICE

CERTIFICATE OF CORRECTION

PATENT NO. : 4,875,327

DATED : October 24, 1989

INVENTOR(S) : Daniel R. Wilde

It is certified that error appears in the above-identified patent and that said Letters Patent is hereby corrected as shown below:

TITLE PAGE:

Abstract, line 14:
"couple" should be --coupled--.

Column 3, line 34:
After "runner" insert --30.--

Column 10, Claim 19, line 57:
"aid" should be --said--.

Column 10, Claim 19, line 61:
After "bracket" delete --.--.

Signed and Sealed this

Ninth Day of April, 1991

*Attest:*

HARRY F. MANBECK, JR.

*Attesting Officer*

*Commissioner of Patents and Trademarks*